US005411610A

United States Patent [19]

Araki et al.

[11] Patent Number: 5,411,610

[45] Date of Patent: May 2, 1995

[54] HIGH-STRENGTH STAINLESS STEEL FOIL FOR CORRUGATING AND PROCESS FOR PRODUCING THE SAME

[75] Inventors: Jun Araki; Jun Nakatuka; Wataru Murata; Hidehiko Sumitomo, all of Hikari; Masayuki Kasuya, Tokai; Hitoshi Ota, Tokai; Yuichi Kato, Tokai; Masuhiro Fukaya, Sagamihara; Keiichi Ohmura, Sagamihara; Mikio Yamanaka, Sagamihara; Fumio Fudanoki, Hikari, all of Japan

[73] Assignee: Nippon Steel Corporation, Tokyo, Japan

[21] Appl. No.: 129,131

[22] PCT Filed: Nov. 19, 1992

[86] PCT No.: PCT/JP92/01513

§ 371 Date: Aug. 19, 1993

§ 102(e) Date: Aug. 19, 1993

[87] PCT Pub. No.: WO93/13235

PCT Pub. Date: Jul. 8, 1993

[30] Foreign Application Priority Data

Dec. 20, 1991 [JP] Japan ..... 3-338439

[51] Int. Cl.[6] ..... C21D 8/00; C22C 38/06

[52] U.S. Cl. ..... 148/542; 148/651; 148/325; 428/606

[58] Field of Search ..... 148/542, 651, 325; 428/606

[56] References Cited

U.S. PATENT DOCUMENTS 5,228,932 7/1993 Shimizu et al. ..... 148/325

FOREIGN PATENT DOCUMENTS 0033203 8/1981 European Pat. Off. .
0246939 11/1987 European Pat. Off. .
0429793 6/1991 European Pat. Off. .
0480461 4/1992 European Pat. Off. .
0516267 12/1992 European Pat. Off. .

OTHER PUBLICATIONS

European Search Report EP 92 92 3986.

*Primary Examiner*—Deborah Yee
*Attorney, Agent, or Firm*—Kenyon & Kenyon

[57] ABSTRACT

According to the present invention, a strength of 120 to 200 kgf/mm$^2$ in terms of 0.2% yield point and optionally a spring critical value of 55 to 150 kgf/mm$^2$ are imparted to a high-strength stainless steel foil for corrugation by subjecting a thin sheet of a stainless steel comprising an alloy composed mainly of 10 to 40% by weight of Cr and 1 to 10% by weight of Al to final cold rolling and optionally subjecting the cold-rolled sheet to an aging treatment at a temperature in the range of from 80° to 500° C. after the completion of the final cold rolling. This enables corrugation to be effected at a high corrugation rate of 10 m/min or more.

14 Claims, 2 Drawing Sheets

HIGH-STRENGTH STAINLESS STEEL FOIL FOR CORRUGATING AND PROCESS FOR PRODUCING THE SAME

TECHNICAL FIELD

The present invention relates to a stainless steel foil for corrugating, which is a component for constituting metallic carriers for catalysts used in exhaust gas purification devices for automobiles, and a process for producing the same. More particularly, the present invention is concerned with a stainless steel foil which is excellent in corrugation workability, i.e., free from unfavorable phenomena, such as foil cracking and foil breaking, even when it is subjected to corrugating.

BACKGROUND ART

Ceramic honeycomb has hitherto been used in carriers for catalysts in automobiles. In recent years, however, a proposal has been made on the use of a metallic honeycomb carrier for catalysts in automobiles having performance superior to the ceramic honeycomb from the viewpoint of the performance of engines, loading, etc. Specifically, a carrier for catalysts in automobiles according to this proposal comprises a metallic honeycomb comprising of alternately wound flat stainless steel foil and corrugated stainless steel foil and a metallic jacket surrounding the metallic honeycomb. This technique is specifically disclosed in, for example, Japanese Unexamined Patent Publication (Kokai) No. 50-92286, 51-48473, 57-71898 and 58-177437.

The process for producing the above-described metallic honeycomb carriers for catalysts in automobiles (hereinafter referred to as "metallic carrier" ) comprises the following steps. (1) A 20Cr-5Al-base stainless steel provided by a melt process is subjected to hot rolling, cold rolling, etc. to form a foil material having a thickness of about 50 μm. (2) The foil material is corrugated to provide a corrugated foil. (3) Then, a honeycomb material comprising of alternately wound flat foil and corrugated foil is formed and incorporated into a jacket. (4) The application of a brazing agent followed by a brazing treatment is effected to join the flat foil to the corrugated foil or to join the foil to the jacket. (5) The resultant carrier is further subjected to a treatment for carrying a catalyst thereon. In the step of cold rolling of a stainless steel among the above-described steps, since the stainless steel has a high work hardenability, it is a common practice to effect the step of once softening the material, i.e., intermediate annealing, before rolling the material into a foil having a thickness of about 50 μm. Since the stainless steel foil thus provided is corrugated in the subsequent step, it is indispensable to impart sufficient corrugation workability to the foil in the step of cold rolling of the stainless steel.

Japanese Unexamined Patent Publication (Kokai) No. 56-152965 discloses a method wherein a stainless steel foil peeled by cutting from the surface of a billet is subjected to a softening annealing treatment for the purpose of facilitating the corrugation (i.e., enhancing the corrugation workability). However, in the method for improving the ductility of the foil by the annealing treatment, although the ductility of the material can be enhanced, since draw breaking of the material unfavorably occurs due to the occurrence of tension, it cannot be said that the corrugation workability of the foil can be satisfactorily improved by this method. Further, the strength of the corrugated product also becomes so low that wavy deformation is liable to occur during subsequent alternate winding of the corrugated foil and flat foil or during use of the final product. For this reason, the above-described method is not suitable for improving the corrugation workability of the foil.

DISCLOSURE OF THE INVENTION

An object of the present invention is to provide a high-strength stainless steel foil for corrugating, which has improved corrugation workability of the foil and, at the same time, has a simplified foil production process through a method different from conventional methods such that the ductility of the foil is improved by an annealing treatment to ensure the corrugation workability, and a process for producing said high-strength stainless steel foil for corrugating.

Another object of the present invention is to provide a stainless steel foil having a particularly excellent corrugation workability and a process for producing the same.

In order to attain the above-described objects, the present inventors have made extensive and intensive studies of cold rolling conditions, which has led to the completion of the present invention. The subject matter of the present invention is as follows.

The characteristic feature of the present invention resides in a stainless steel foil comprising, in terms of % by weight, 10 to 40% of Cr and 1 to 10% of Al, said stainless steel foil having a strength of 120 to 200 kgf/mm$^2$ in terms of 0.2% yield point and optionally a spring critical value of 55 to 150 kgf/mm$^2$.

The present inventors have effected various studies on the corrugation workability of stainless steel foils. As a result, they have found, by experiment, that in order to prevent the occurrence of unfavorable phenomena during corrugation of the stainless steel foils, such as cracking and breaking, it is most important for the stainless steel foils to have a strength of 120 to 200 kgf/mm$^2$ in terms of 0.2% yield point.

Specifically, in the experiment effected by the present inventors, slabs of alloys A, H, I, J and K among the alloys specified in Table 1 were hot-rolled, cold-rolled, annealed, pickled, subjected to final cold rolling with varied total draft to form foils which were then corrugated under two conditions, that is, a corrugation rate of 10 m/min and a corrugation rate of 20 m/min. The results are given as test Nos. 22, 23, 24, 25, 26, 29 and 30 in Table 2. All the materials indicated as the test Nos. 22 to 26 subjected to final cold rolling with a total reduction ratio of 75% or more had a 120 kgf/mm$^2$ or more in terms of 0.2% yield point and could be successfully corrugated at a corrugation rate of 10 m/min. However, corrugation could not be properly effected at a high rate (i.e., at a corrugation rate of 20 m/min).

On the other hand, in the test Nos. 29 and 30, the materials subjected to final cold rolling with a total draft of less than 75% [in test No. 30, the material after the final cold rolling was subjected to complete softening annealing (the material had a strength of 50 kgf/mm$^2$ or less in terms of 0.2% yield point because the structure of the steel became a recrystallized structure by the heat treatment)] had a strength of less than 120 kgf/mm$^2$ in terms of 0.2% yield point and could not be corrugated due to the occurrence of breaking even at a low corrugation rate (i.e., a working rate of 10 m/min).

The above-described corrugation was effected with a toothed rotary roll [a device provided with a pair of facing shaft drive rolls having gear teeth arranged in a zigzag pattern (see Japanese Unexamined Patent Publication No. 56-152965)]. In such corrugation with the rotary roll, since the corrugation is effected with the material being drawn into between the rolls from the rear, tension occurs by the friction between the tooth edge and the material. At that time, when the yield point of the material is small, work breaking occurs. For this reason, the strength should be 120 kgf/mm$^2$ or more in terms of 0.2% yield point. The higher the yield point, the better the results. However, the yield point is preferably 200 kgf/mm$^2$ or less from the viewpoint of limitations of production of the foil, strength of corrugating tools, capacity of corrugating facilities, etc. In order to attain such an yield point, it is necessary to effect the final cold rolling with a total reduction ratio of 75% or more.

When the resistance of the material to bending (spring critical value) is small, the material is bent around the teeth by the tooth edge during corrugation, which increases the frictional force. This in turn increases the tension during corrugation, so that breaking becomes liable to occur.

The present inventors have effected studies on the resistance of the above-described material to bending and, as a result, have confirmed that no significant improvement in the resistance, that is, the spring critical value, can be attained by the cold rolling alone and that the best results can be obtained by effecting age hardening by an aging treatment in addition to the work hardening by the cold rolling and it is useful to bring the spring critical value to 55 to 150 kgf/mm$^2$ by this treatment.

Specifically, the present inventors have subjected slabs of alloys A, C, D, E, F, G, H, I, J, K and M among the alloys specified in Table 1 to the same steps as described above to form foils which were then subjected to an aging treatment and corrugated under the same conditions as described above. As a result, materials having a 0.2% yield point of 120 kgf/mm$^2$ or more and a spring critical value of 55 kgf/mm$^2$ or more indicated as test Nos. 1 to 20 could be successfully corrugated under both of two conditions, that is, a corrugation rate of 10 m/min and a corrugation rate of 20 m/min.

On the other hand, in test No. 21, since the heating temperature in the aging treatment was as low as 60° C., the spring critical value was as low as 29 kgf/mm$^2$, while in test Nos. 27 and 28, since the 0.2% yield point was as low as 120 kgf/mm$^2$ or less although the spring critical value was 55 kgf/mm$^2$ or more, both the materials could not be successfully corrugated at a high corrugation rate.

The material indicated as test No. 22 had a spring critical value of 50 kgf/mm$^2$ without subjecting to the aging treatment. This material, however, could not be successfully corrugated at a high corrugation rate.

Accordingly, the spring critical value should be at least 55 kg/mm$^2$ or more.

The higher the spring critical value, the better the results. However, for the same reason as described above in connection with the 0.2% yield point, the spring critic value is preferably 150 kgf/mm$^2$ or less.

As can be seen from Table 2, the heating temperature in the aging treatment should be 80° C. or above. Since, however, an excessively high heating temperature gives rise to the recovery of dislocation to soften the material, the upper heating temperature is limited to 500° C. The heating time may be shortened with an increase in the heating temperature. For example, when the heating temperature is 300° C., the heating time may be 1 sec or more. The heating may be effected in the air. Alternatively, it may be effected in a non-oxidizing atmosphere, such as in vacuum or in an inert gas.

With respect to evaluation of properties, the 0.2% yield point was determined by a tensile test according to JIS Z 2241, and the spring critical value was determined by a moment test according to JIS H 3130. The corrugation workability was evaluated according to the following three grades ○: no cracking, Δ: slight cracking, and X: impossible to pass the material between the rolls.

The reason for the limitation of ingredients in the present invention will now be described.

Cr is a fundamental element for ensuring the corrosion resistance and oxidation resistance of the stainless steel. In the present invention, when the Cr content is less than 10%, these properties are not satisfactory. On the other hand, it exceeds 40%, since the toughness of hot-rolled sheets deteriorates, the producibility lowers. For this reason, the Cr content was limited to 10 to 40%.

Al is a fundamental element for ensuring the oxidation resistance. When the Al content is less than 1% the oxidation resistance lowers. On the other hand, when it exceeds 10%, since the toughness of hot-rolled sheets deteriorates, the producibility lowers. For this reason, the Al content was limited to 1 to 10%.

Other ingredients capable of improving the oxidation resistance, toughness and strength can be added. The function and preferred amount of such ingredients will now be described.

Examples of elements capable of enhancing the oxidation resistance include Y and Ln (lanthanoid) (Ln represents mixtures of La, Ce, Pr and Nd), La and Ce which are rare-earth elements. These elements serve to increase the adhesion between the stainless steel and the surface oxide to improve the oxidation resistance and, at the same time, to remarkably improve the service life of the foil. When the total amount of at least one member selected from Y, Ln, La and Ce is less than 0.01%, no satisfactory effect can be ensured. On the other hand, when the total amount exceeds 1%, the effect is saturated and, at the same time, the raw material cost becomes remarkably high because these elements are very expensive. For this reason, at least one member selected from Y, Ln, La and Ce is preferably contained in a total amount of 0.01 to 1% as an ingredient in the material for the metallic carrier in exhaust gas purification devices.

Similarly, Ti, Nb, Ta, V, Zr and Hf form a nitride or a carbide to reduce C and N in a solid solution form and, at the same time, precipitate on dislocation introduced during hot rolling of the stainless steel to refine the structure, thereby improving the toughness of the hot-rolled sheet. When the total amount of at least one member selected from the above-described elements is less than 0.01%, no sufficient effect can be ensured. On the other hand, when the total amount exceeds 5%, the effect is saturated and, at the same time, the raw material cost becomes remarkably high because these elements are expensive. For this reason, it is preferred for Ti, Nb, Ta, V, Zr and Hf to be contained in a total amount of 0.01 to 5%.

Mo and W serve to improve the strength of the stainless steel. When one or both of these elements are contained in a total amount of less than 1%, no satisfactory effect can be ensured. On the other hand, when these elements are contained in a total amount exceeding 5%, the effect is saturated and, at the same time, the toughness of the hot-rolled sheet remarkably deteriorates. For this reason, it is preferred for Mo and W to be contained in a total amount of 1 to 5%.

A stainless steel having a strength and a spring critical value contemplated in the present invention can be produced from a material comprising the above-described ingredients.

BEST MODE FOR CARRYING OUT THE INVENTION

The best mode for carrying out the invention will now be described.

At the outset, an alloy comprising the above-described chemical composition is prepared by a melt process. An ingot of the alloy is prepared from the alloy. The ingot is subjected to blooming and hot rolling. Alternatively, a cast strip produced by subjecting the above-described alloy to continuous casting may be hot-rolled. The hot-rolling provides a hot-rolled sheet having a thickness of 2.5 to 6.0 mm.

The hot-rolled sheet is cold-rolled into a cold-rolled sheet having a thickness of 0.6 to 1.5 mm which is then annealed by holding it at 850° to 1000° C. for 10 to 60 sec and subjected to cold rolling with a total thickness from the first pass to the final pass of 75 to 98% to provide a foil having a thickness of 0.050 to 0.150 mm.

The above-described foil may be produced also by effecting the above-described annealing as intermediate annealing, cold-rolling the steel sheet after the intermediate annealing to form a cold-rolled sheet having a thickness of 0.2 to 0.8 mm, holding the cold-rolled sheet at 850° to 1000° C. for 10 to 60 sec to effect final annealing and cold-rolling the annealed steel sheet with a total reduction ratio of 75 to 94%.

The foil thus produced can have a high strength of 120 to 200 kgf/mm$^2$ in terms of 0.2% yield point.

Figure 1:
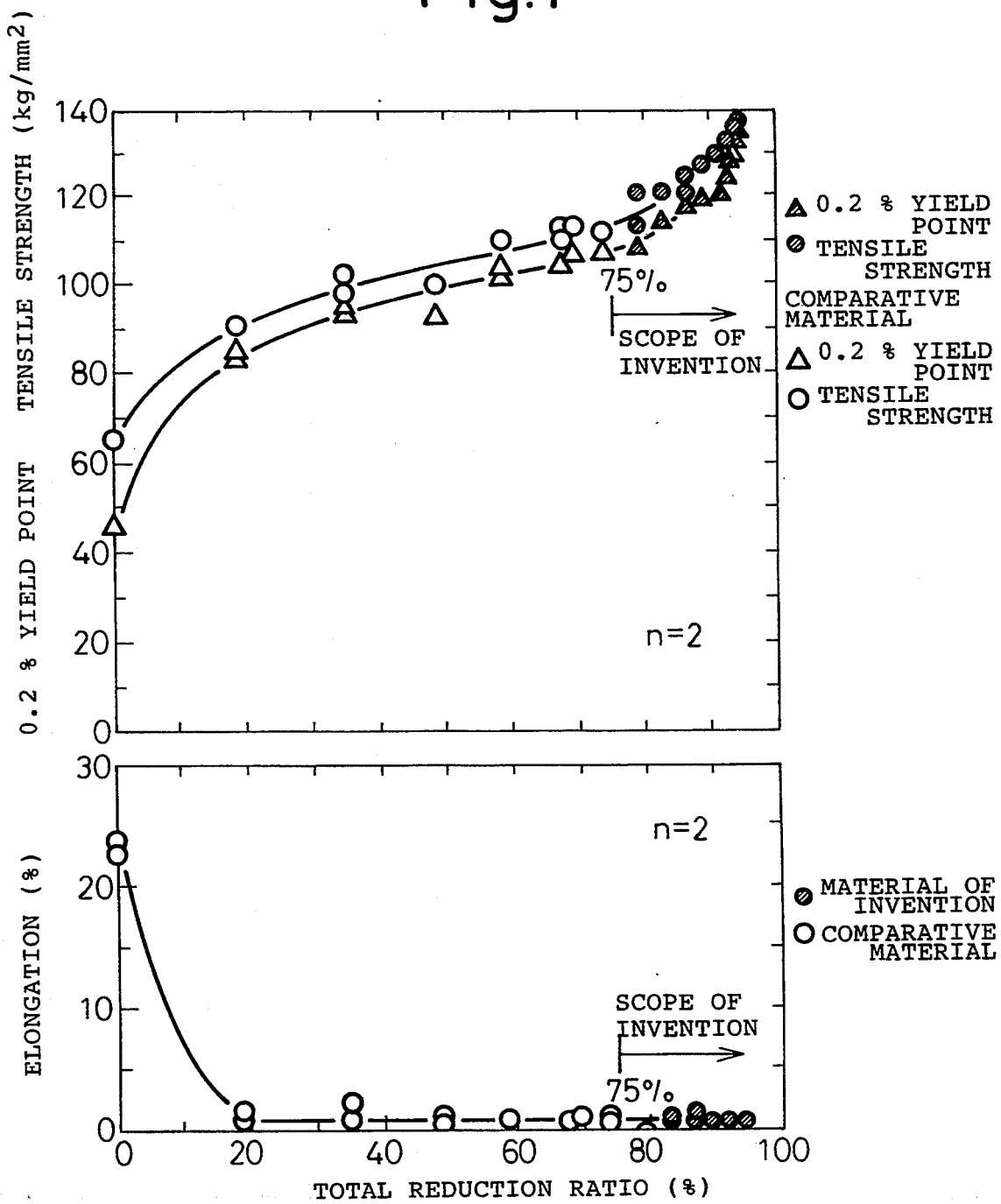
FIG. 1 is a graph showing work hardening properties of a 20Cr-5Al steel foil.

FIG. 1 is a graph showing the work hardening properties of a 20Cr-5Al-0.1Ln-0.05Ti steel foil (alloy system A in Table 1). In this graph, the work hardenability is shown in terms of the relationship between the total reduction ratio and the 0.2% yield point, tensile strength and elongation. Both the 0.2% yield point and tensile strength rapidly increase until the total reduction ratio reaches about 40%, then gradually increase until the total reduction ratio reaches about 75%, and again significantly increase when the total reduction ratio is further increased. On the other hand, the elongation rapidly lowers until the total reduction ratio reaches 20%, and becomes constant at about 1 to 2% when the total reduction ratio is further increased. From this fact, it is apparent that a high reduction ratio is necessary for increasing the strength of the foil. A total reduction ratio of 75% or more falls within the scope of the present invention.

Figure 2:
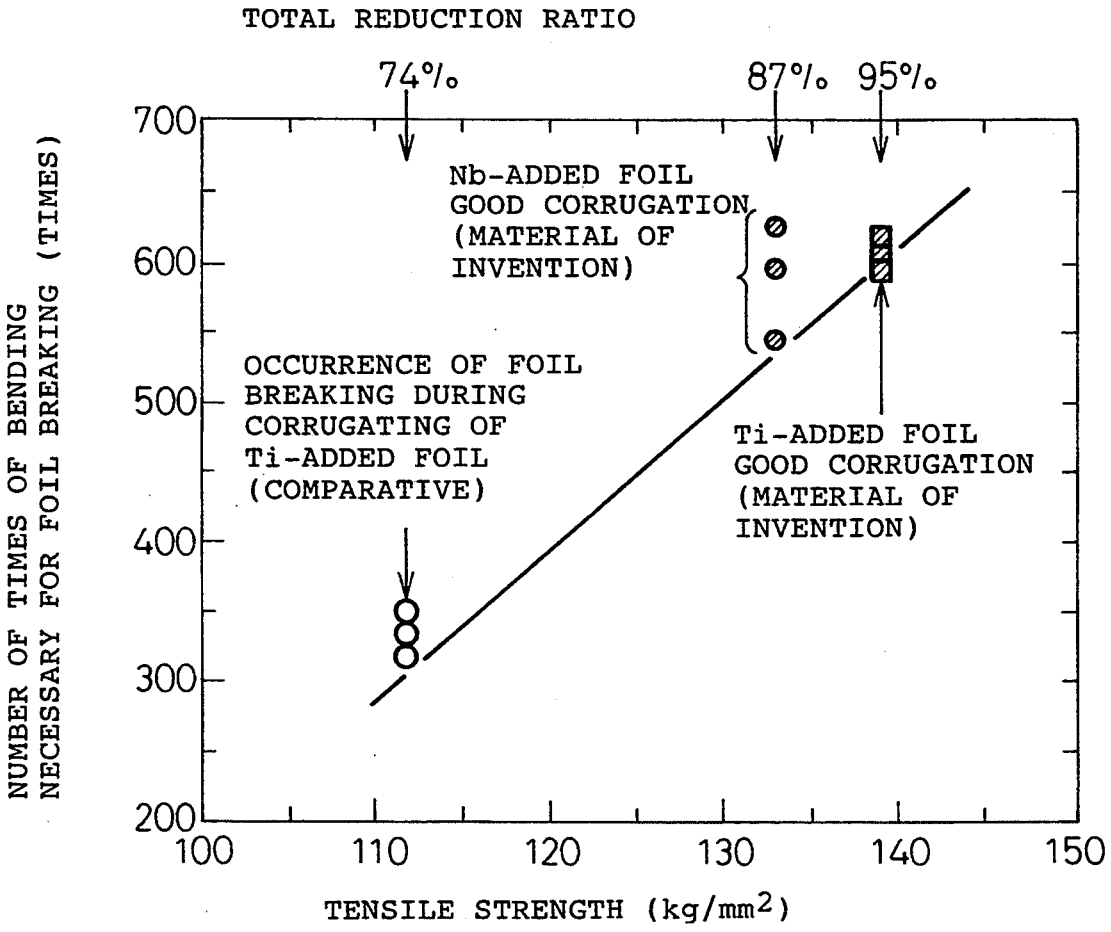
FIG. 2 is a graph showing the relationship between the susceptibility to corrugation cracking and the tensile strength and bending resistance of the foil.

FIG. 2 is a graph showing the relationship between the susceptibility to corrugation cracking and the tensile strength and bending strength with respect to a 20Cr-5Al-0.1Ln-0.05Ti (Ti-added foil) steel foil (alloy system A) and a 20Cr-5Al-0.4Ln-0.16Nb (Nb-added foil) steel foil (alloy system B) (0.052 mm). A foil subjected to cold rolling with a total reduction ratio of 74% breaks when it has been bent 300 to 400 times in a repeated bending test, whereas a foil subjected to cold rolling with a total reduction ratio of 87% or more breaks when it has been bent about 600 times in a repeated bending test. The results of this repeated bending test demonstrate that there is a tendency for foils to be susceptible to cracking when they have a low strength, but that they are less susceptible to cracking when they have a high strength. Accordingly, it is apparent that an increase in the strength of the foil through an enhancement in the total reduction ratio in the rolling of the foil contributes to an improvement in the bending strength of the foil in the repeated bending test to enhance the effect of preventing the occurrence of breaking of the foil, that is, an increase in the strength of the foil contributes to an improvement in the corrugation workability of the foil.

The above-described hot-rolled sheet may be provided also by directly casting a steel strip having a thickness corresponding to the thickness of the hot-rolled sheet in a continuous manner with the use of a movable mold in a twin roll system.

TABLE 1

| | Alloy system | C | Si | Mn | P | S | Cr | Al | Ln | Y | Ni, Ti, Nb, Mo, Ta, W, Zr, V, Hf | N | O |
|---|---|---|---|---|---|---|---|---|---|---|---|---|---|
| A | 20Cr—5Al—0.011Ln—0.05Ti | 0.006 | 0.31 | 0.17 | 0.031 | 0.0006 | 19.70 | 5.26 | 0.105 | — | Ti:0.054 | 0.0072 | 0.0005 |
| B | 20Cr—5Al—0.04Ln—0.16Nb | 0.005 | 0.43 | 0.17 | 0.022 | 0.0005 | 19.91 | 5.09 | 0.041 | — | Nb:0.160 | 0.0077 | 0.0008 |
| C | 20Cr—5Al—0.09Ln—2.5Mo | 0.007 | 0.31 | 0.19 | 0.018 | 0.0010 | 20.32 | 5.16 | 0.086 | — | Mo:2.49 | 0.0025 | 0.0009 |
| D | 20Cr—5Al—0.08Y—1.2Ta | 0.008 | 0.31 | 0.20 | 0.014 | 0.0009 | 19.27 | 5.20 | — | 0.076 | Ta:1.18 | 0.0062 | 0.0003 |
| E | 20Cr—5Al—0.08Ln—1.7W | 0.010 | 0.30 | <0.1 | 0.023 | 0.0011 | 19.87 | 5.28 | 0.087 | — | W:1.66 | 0.0015 | 0.0004 |
| F | 20Cr—5Al—0.06Ln—1.1Zr | 0.007 | 0.34 | 0.29 | 0.020 | 0.0016 | 19.79 | 5.30 | 0.064 | | Zr:1.10 | 0.0032 | 0.0004 |
| G | 20Cr—5Al—0.06Ln—0.6V—0.2Hf | 0.013 | 0.32 | 0.13 | 0.019 | 0.0002 | 20.30 | 5.31 | 0.061 | — | V:0.6, Hf:0.2 | 0.0021 | 0.0004 |
| H | 20Cr—5Al | 0.009 | 0.36 | 0.14 | 0.021 | 0.0010 | 19.97 | 5.21 | — | — | — | 0.0052 | 0.0005 |
| I | 15Cr—5Al | 0.007 | 0.33 | 0.16 | 0.016 | 0.0004 | 15.31 | 5.13 | — | — | — | 0.0037 | 0.0003 |
| G | 38Cr—2.5Al | 0.006 | 0.32 | 0.17 | 0.018 | 0.0008 | 37.78 | 2.52 | — | — | — | 0.0056 | 0.0004 |
| K | 25Cr—7Al | 0.011 | 0.41 | 0.22 | 0.014 | 0.0008 | 24.85 | 7.24 | — | — | — | 0.0077 | 0.0005 |
| L | 20Cr—5Al—0.05Y—0.3Nb | 0.006 | 0.30 | 0.21 | 0.022 | 0.0005 | 20.27 | 5.23 | — | 0.057 | Nb:0.31 — | 0.0032 | 0.0005 |
| M | 20Cr—5Al—0.03Y—0.3Nb—0.1Mo | 0.009 | 0.30 | 0.21 | 0.021 | 0.0005 | 20.44 | 5.24 | — | 0.036 | Nb:0.30, Mo:1.0 | 0.0033 | 0.0003 |

TABLE 2

| No. | Alloy system | | Total reduction ratio (%) | Sheet thickness (μm) | Heat treatment temp. (°C.) | Heat treatment time (min) | Spring critical value (kgf/mm²) | Yield point: σ0.2 (kgf/mm²) | Corrugating rate and test results (m/min) 10 | 20 |
|---|---|---|---|---|---|---|---|---|---|---|
| Ex. of invention | | | | | | | | | | |
| 1 | A | 20Cr—5Al—0.11Ln—0.05Ti | 95 | 52 | 80 | 5 | 56 | 131 | ○ | ○ |
| 2 | A | 20Cr—5Al—0.11Ln—0.05Ti | 95 | " | 150 | 1 | 81 | 130 | ○ | ○ |
| 3 | A | 20Cr—5Al—0.11Ln—0.05Ti | 95 | " | 150 | 5 | 95 | 134 | ○ | ○ |
| 4 | A | 20Cr—5Al—0.11Ln—0.05Ti | 95 | 48 | 150 | 20 | 103 | 137 | ○ | ○ |
| 5 | A | 20Cr—5Al—0.11Ln—0.05Ti | 95 | " | 200 | 1 | 101 | 139 | ○ | ○ |
| 6 | A | 20Cr—5Al—0.11Ln—0.05Ti | 95 | 75 | 200 | 5 | 108 | 142 | ○ | ○ |
| 7 | A | 20Cr—5Al—0.11Ln—0.05Ti | 91 | 62 | 300 | 1 | 106 | 139 | ○ | ○ |
| 8 | A | 20Cr—5Al—0.11Ln—0.05Ti | 91 | " | 400 | 1 | 100 | 136 | ○ | ○ |
| 9 | A | 20Cr—5Al—0.11Ln—0.05Ti | 91 | 52 | 500 | 1 | 88 | 131 | ○ | ○ |
| 10 | C | 20Cr—5Al—0.09Ln—2.5Mo | 87 | 50 | 200 | 5 | 98 | 128 | ○ | ○ |
| 11 | D | 20Cr—5Al—0.08Y—1.2Ta | 87 | " | 300 | 1 | 101 | 129 | ○ | ○ |
| 12 | E | 20Cr—5Al—0.08Ln—1.7W | 91 | 52 | 200 | 1 | 96 | 137 | ○ | ○ |
| 13 | F | 20Cr—5Al—0.06Ln—1.1Zr | 91 | " | 200 | 1 | 93 | 135 | ○ | ○ |
| 14 | G | 20Cr—5Al—0.06Ln—0.6V—0.2Hf | 91 | 120 | 300 | 1 | 106 | 129 | ○ | ○ |
| 15 | H | 20Cr—5Al | 95 | 52 | 200 | 1 | 101 | 139 | ○ | ○ |
| 16 | I | 15Cr—5Al | 95 | " | 200 | 1 | 103 | 145 | ○ | ○ |
| 17 | G | 38Cr—2.5Al | 91 | " | 400 | 1 | 100 | 146 | ○ | ○ |
| 18 | K | 25Cr—7Al | 91 | " | 300 | 1 | 107 | 141 | ○ | ○ |
| 19 | L | 20Cr—5Al—0.05Y—0.3Nb | 91 | " | 200 | 1 | 102 | 122 | ○ | ○ |
| 20 | M | 20Cr—5Al—0.03Y—0.3Nb—0.1Mo | 91 | " | 200 | 1 | 97 | 132 | ○ | ○ |
| 21 | A | 20Cr—5Al—0.11Ln—0.05Ti | 91 | " | 60 | 5 | 29 | 135 | ○ | x |
| 22 | A | 20Cr—5Al—0.11Ln—0.05Ti | 95 | 50 | — | | 50 | 124 | ○ | x |
| 23 | H | 20Cr—5Al | 95 | 52 | — | | 45 | 136 | ○ | x |
| 24 | I | 15Cr—5Al | 95 | " | — | | 48 | 133 | ○ | x |
| 25 | G | 38Cr—2.5Al | 91 | " | — | | 42 | 138 | ○ | x |
| 26 | K | 25Cr—7Al | 91 | " | — | | 45 | 134 | ○ | x |
| Comp. Ex. | | | | | | | | | | |
| 27 | A | 20Cr—5Al—0.11Ln—0.05Ti | 74 | 52 | 200 | 10 | 79 | 115 | Δ | x |
| 28 | A | 20Cr—5Al—0.11Ln—0.05Ti | 91 | " | 600 | 5 | 68 | 118 | Δ | x |
| 29 | A | 20Cr—5Al—0.11Ln—0.05Ti | 74 | " | — | | 31 | 102 | x | x |
| 30 | A | 20Cr—5Al—0.11Ln—0.05Ti | 0 | " | — | | — | 45 | x | x |

Then, when the corrugation is effected at a high rate of 10 m/min or more, the above-described foil is subjected to aging heat treatment under conditions of a temperature of 80° to 500° C. and a holding time of 0.1 to 30 min. This treatment enables the foil to have a spring critical value of 55 to 150 kgf/mm².

Thus, when the foil has a strength of 120 to 200 kgf/mm² in terms of 0.2% yield point and a spring critical value of 55 to 150 kgf/mm², it can be successfully corrugated, without cracking, even when it is corrugated at the high rate of 20 to 50 m/min.

EXAMPLES

Example 1

The results of a corrugation test for materials of the invention (alloy systems A to G in Table 1) and a comparative material (alloy system A in Table 1) are given in Table 3. Material 1 of the invention was prepared by hot-rolling a slab of a 20Cr-5Al-0.11Ln-0.05Ti steel (alloy system A), cold-rolling the hot-rolled sheet into a cold-rolled sheet having a thickness of 1 mm, annealing the cold-rolled sheet and rolling the annealed sheet into a sheet having a thickness of 0.052 mm. That is, a high-strength foil having a 0.2% yield point of 134 kgf/mm² was prepared by subjecting the annealed sheet to rolling with a total reduction ratio of 95%. Materials 2 to 4 of the invention were prepared by annealing a 20Cr-5Al-0.09Ln-2.5Mo steel (alloy system C), a 20Cr-5Al-0.08Y-1.2Ta steel (alloy system D) and a 20Cr-5Al-0.04Ln-0.16Nb steel (alloy system B) in a thickness of 0.4 mm and then rolling the annealed steels into sheets having a thickness of 0.052 mm. That is, high-strength foils having respective 0.2% yield points of 127 kgf/mm², 126 kgf/mm² and 123 kgf/mm² were prepared by subjecting the annealed sheets to rolling with a total reduction ratio of 87%. Materials 5 to 7 of the invention were prepared by annealing a 20Cr-5Al-0.09Ln-1.7W steel (alloy system E), a 20Cr-5Al-0.06Ln-1.1Zr steel (alloy system F) and a 20Cr-5Al-0.06Ln-0.6V-0.2Hf steel (alloy system G) in a thickness of 0.6 mm and then rolling the annealed steels with a total reduction ratio of 91% to provide high-strength foils having respective 0.2% yield points of 131 kgf/mm², 130 kgf/mm² and 133 kgf/mm². On the other hand, a comparative material was prepared by annealing a steel having the same composition as the material 1 of the invention, that is, a 20Cr-5Al-0.11Ln-0.05Ti steel, in a thickness of 0.2 mm and then rolling the annealed sheet into a sheet having a thickness of 0.052 mm, that is, with a total reduction ratio of 74% to provide a foil having a 0.2% yield point of 118 kgf/mm².

A corrugation test was effected with varied corrugation rates, i.e., at 3 m/min, 6 m/min, 8 m/min and 10 m/min. The corrugation workability was evaluated according to the following three grades ○: no cracking, Δ: slight cracking, and X: impossible to pass the foil through the rolls. In the test, all the high-strength foils of the present invention could be successfully corrugated without cracking at any corrugation rate of 3 to 10 m/min, that is, exhibited good corrugation workability. On the other hand, in the comparative material, the foil slightly cracked even at a low corrugation rate of 3 m/min and became impossible to pass through between the rolls. Therefore, it is apparent that an increase in the strength of the foil through an increase in the total reduction ratio in the rolling can improve the corrugation workability of the foil and prevent the occurrence of cracking of the foil.

TABLE 3

| Classification | Alloy system | Total reduction ratio (%) | 0.2% yield point (kgf/mm²) | Process Numeral: sheet thickness (mm) | | | | | Corrugating rate and test results (m/min) 3 | 6 | 8 | 10 |
|---|---|---|---|---|---|---|---|---|---|---|---|---|
| Material 1 of invention | 20Cr—5Al—0.11Ln—0.05Ti (A) | 95 | 134 | Annealing 1.0 | cold rolling | | cold rolling | foil 0.052 | ○ | ○ | ○ | ○ |
| Material 2 of invention | 20Cr—5Al—0.09Ln—2.5Mo (C) | 87 | 127 | Intermediate annealing 1.0 | cold rolling | final annealing 0.4 | cold rolling | foil 0.052 | ○ | ○ | ○ | ○ |
| Material 3 of invention | 20Cr—5Al—0.08Y—1.2Ta (D) | 87 | 126 | Intermediate annealing 1.0 | cold rolling | final annealing 0.4 | cold rolling | foil 0.052 | ○ | ○ | ○ | ○ |
| Material 4 of invention | 20Cr—5Al—0.04Ln—0.16Nb (B) | 87 | 123 | Intermediate annealing 1.0 | cold rolling | final annealing 0.4 | cold rolling | foil 0.052 | ○ | ○ | ○ | ○ |
| Material 5 of invention | 20Cr—5Al—0.09Ln—1.7W (E) | 91 | 131 | Intermediate annealing 1.2 | cold rolling | final annealing 0.6 | cold rolling | foil 0.052 | ○ | ○ | ○ | ○ |
| Material 6 of invention | 20Cr—5Al—0.06Ln—1.1Zr (F) | 91 | 130 | Intermediate annealing 1.2 | cold rolling | final annealing 0.6 | cold rolling | foil 0.052 | ○ | ○ | ○ | ○ |
| Material 7 of invention | 20Cr—5Al—0.06Ln—0.6V—0.2Hf (G) | 91 | 133 | Intermediate annealing 1.2 | cold rolling | final annealing 0.6 | cold rolling | foil 0.052 | ○ | ○ | ○ | ○ |
| Comparative material 8 | 20Cr—5Al—0.11Ln—0.05Ti (A) | 74 | 118 | Intermediate annealing 1.0 | cold rolling | final annealing 0.2 | cold rolling | foil 0.052 | Δ | X | X | X |

Note) ○: no cracking
Δ: small degree of crack occurred
X: impossible to pass foil through between rolls

Example 2

The results of a corrugation test for materials of the invention (selected from the materials listed in Table 1) subjected to an aging treatment and a comparative material (selected from the materials listed in Table 1) are given in Table 4. Material 9 of the invention was prepared by hot-rolling a continuously cast strip of a 20Cr-5Al-0.11Ln-0.05Ti steel (alloy system A in Table 1), cold-rolling the hot-rolled strip into a cold-rolled strip having a thickness of 1.2 mm, subjecting the cold-rolled strip to intermediate annealing, rolling the annealed strip into a rolled strip having a thickness of 0.6 mm, subjecting the rolled strip to final annealing and rolling the annealed strip into a rolled strip having a thickness of 0.052 mm, that is, subjecting the annealed strip to rolling with a total reduction ratio of 91% to provide a high-strength foil having a 0.2% yield point of 131 kgf/mm², then subjecting the foil to an aging treatment at 500° C. for 1 min to have a spring critical value of 88 kgf/mm².

Materials 10 to 12 of the invention were prepared by subjecting materials of alloy systems C, E, G and M listed in Table 1 to treatments by the same steps as used in the above-described material 9 of the invention (except that the total reduction ratio was as specified in Table 4) to provide high-strength foils respectively having 0.2% yield points of 128 kgf/mm², 137 kgf/mm², 129 kgf/mm² and 132 kgf/mm² and spring critical values of 101 kgf/mm², 96 kgf/mm², 106 kgf/mm² and 97 kgf/mm².

Material 13 of the present invention was prepared by hot-rolling a slab of a 20Cr-5Al steel (alloy system H listed in Table 1), cold-rolling the hot-rolled strip into a strip having a thickness of 1 mm, annealing the cold-rolled strip and rolling the annealed strip into a strip having a thickness of 0.052 mm, that is, subjecting the annealed strip to cold rolling with a total reduction ratio of 95% to provide a high-strength foil having a 0.2% yield point of 139 kgf/mm², and then subjecting the foil to an aging treatment at 200° C. for 1 min to have a spring critical value of 101 kgf/mm².

On the other hand, comparative materials 15 and 16 were prepared by hot-rolling a slab having the same composition as the material 1 of the invention (alloy system A listed in Table 1), cold-rolling the hot-rolled material into a strip having thickness of 1.0 mm and a strip having a thickness of 1.2 mm, subjecting the strips to intermediate annealing, rolling the annealed strips into strips having respective thicknesses of 0.2 mm and 0.6 mm, subjecting the rolled strips to final annealing, cold-rolling the annealed strips with total reduction ratios of 74% and 91% to provide foils having a thickness of 0.052 mm and then subjecting the foils to an aging treatment at 200° C. for 1 min in the case of the comparative material 15 and 600° C. for 5 min in the case of the comparative material 16.

A corrugation test was effected with varied corrugation rates, i.e., at 13 m/min, 16 m/min, 20 m/min and 23 m/min. In the test, all the high-strength foils of the present invention could be successfully corrugated without cracking at any corrugation rate of 13 to 20 m/min, that is, exhibited good corrugation workability. When the corrugation was effected at a rate of 23 m/min, slight cracking occurred in the material 9 of the invention due to a high treatment temperature in the aging annealing. On the other hand, in the comparative material 15, since the total reduction ratio was less than 75%, the 0.2% yield point was as low as 115 kgf/mm² and the material broke during corrugation at a high rate and could not be passed through the rolls although the aging treatment condition fell within the scope of the present invention.

In the comparative material 16, although the total reduction ratio was 91%, i.e., fell within the scope of the present invention, since the temperature in the aging treatment was above 500° C., the 0.2% yield point was 118 kgf/mm$^2$, i.e., outside the scope of the present invention, so that corrugation at a high rate could not be successfully effected although the spring critical value satisfied the requirement of the present invention.

TABLE 4

| Classification | Alloy system | Total reduction ratio (%) | 0.2% yield point (kgf/mm$^2$) | Spring critical value (kgf/mm$^2$) | Process Numeral: sheet thickness (mm) | | | | | | Corrugating rate and test results (m/min) 13 | 16 | 20 | 23 |
|---|---|---|---|---|---|---|---|---|---|---|---|---|---|---|
| Material 9 of invention | 20Cr—5Al—0.11Ln—0.05Ti (A) | 91 | 131 | 88 | Intermediate annealing 1.2 | cold rolling | final annealing 0.6 | cold rolling | foil 0.052 | aging treatment 500° C. × 1 min | ○ | ○ | ○ | ○ |
| Material 10 of invention | 20Cr—5Al—0.09Ln—2.5Mo (C) | 87 | 128 | 101 | Intermediate annealing 1.0 | cold rolling | final annealing 0.2 | cold rolling | foil 0.050 | aging treatment 200° C. × 5 min | ○ | ○ | ○ | ○ |
| Material 11 of invention | 20Cr—5Al—0.08Ln—1.7W (E) | 91 | 137 | 96 | Intermediate annealing 1.2 | cold rolling | final annealing 0.6 | cold rolling | foil 0.052 | aging treatment 200° C. × 1 min | ○ | ○ | ○ | ○ |
| Material 12 of invention | 20Cr—5Al—0.06Ln—0.6V—0.2Hf (G) | 91 | 129 | 106 | Intermediate annealing 1.0 | cold rolling | final annealing 0.8 | cold rolling | foil 0.120 | aging treatment 300° C. × 1 min | ○ | ○ | ○ | ○ |
| Material 13 of invention | 20Cr—5Al (H) | 95 | 139 | 101 | Annealing 1.0 | cold rolling | | cold rolling | foil 0.052 | aging treatment 200° C. × 1 min | ○ | ○ | ○ | ○ |
| Material 14 of invention | 20Cr—5Al—0.03Y—0.3Mo—0.1Nb (M) | 91 | 132 | 97 | Intermediate annealing 1.2 | cold rolling | final annealing 0.6 | cold rolling | foil 0.052 | aging treatment 200° C. × 1 min | ○ | ○ | ○ | ○ |
| Comparative material 15 | 20Cr—5Al—0.11Ln—0.05Ti (A) | 74 | 115 | 79 | Intermediate annealing 1.0 | cold rolling | final annealing 0.2 | cold rolling | foil 0.052 | aging treatment 200° C. × 10 min | X | X | X | X |
| Comparative material 16 | 20Cr—5Al—0.11Ln—0.05Ti (A) | 91 | 118 | 68 | Intermediate annealing 1.2 | cold rolling | final annealing 0.6 | cold rolling | foil 0.052 | aging treatment 600° C. × 5 min | X | X | X | X |

Note) ○: no cracking
Δ: small degree of crack occurred
X: impossible to pass foil through rolls

INDUSTRIAL APPLICABILITY

As is apparent from the foregoing detailed description, according to the present invention, since the corrugation hardenability of the stainless steel foil can be remarkably improved, the present invention is suitable for the production of corrugated steel foils used in metallic carriers for catalysts in exhaust gas purification devices for automobiles. Further, in the present invention, the step of high-temperature annealing before corrugation is unnecessary and, at the same time, it has become possible to effect the corrugation at a high rate, which is advantageous from the viewpoint of cost of facilities and enables the production cost of the metallic carrier etc. to be reduced. This renders the present invention very valuable from the viewpoint of industry.

We claim:

1. A high-strength ferritic stainless steel foil for corrugation, comprising an alloy composed mainly of 10 to 40% by weight of Cr, 1 to 10% by weight of Al, and a balance of iron, and having a strength of 120 to 200 kgf/mm$^2$ in terms of 0.2% yield point.

2. A high-strength ferritic stainless steel foil for corrugation, comprising an alloy composed mainly of 10 to 40% by weight of Cr, 1 to 10% by weight of Al, and a balance of iron, and having a strength of 120 to 200 kgf/mm$^2$ in terms of 0.2% yield point and a spring critical value of 55 to 150 kgf/mm$^2$.

3. A process for producing a high-strength ferritic stainless steel foil for corrugation, comprising cold-rolling a thin sheet of a stainless steel comprising an alloy composed mainly of 10 to 40% by weight of Cr, 1 to 10% by weight of Al, and a balance of iron, annealing the thin sheet and cold-rolling the annealed sheet with a total reduction ratio from the first pass to the final pass of 75% or more.

4. The process according to claim 3, wherein said thin sheet is a hot-rolled material.

5. The process according to claim 3, wherein said thin sheet is a continuously cast strip.

6. A process for producing a high-strength ferritic stainless steel foil for corrugation, comprising cold-rolling a thin sheet of a stainless steel comprising an alloy composed mainly of 10 to 40% by weight of Cr, 1 to 10% by weight of Al, and a balance of iron, subjecting the cold-rolled sheet to intermediate annealing, cold-rolling the annealed sheet, subjecting the cold-rolled sheet to final annealing and cold-rolling the annealed sheet with a total reduction ratio from the first pass to the final pass of 75% or more.

7. The process according to claim 6, wherein said thin sheet is a hot-rolled material.

8. The process according to claim 6, wherein said thin sheet is a continuously cast strip.

9. A process for producing a high-strength ferritic stainless steel foil for corrugation, comprising cold-rolling a thin sheet of a stainless steel comprising an alloy composed mainly of 10 to 40% by weight of Cr, 1 to 10% by weight of Al, and a balance of iron, annealing the thin sheet, cold-rolling the annealed sheet with a total reduction ratio from the first pass to the final pass of 75% or more and heat-treating the cold-rolled sheet at a temperature in the range of from 80° to 500° C.

10. The process according to claim 9, wherein said thin sheet is a hot-rolled material.

11. The process according to claim 9, wherein said thin sheet is a continuously cast strip.

12. A process for producing a high-strength ferritic stainless steel foil for corrugation, comprising cold-rolling a thin sheet of a stainless steel comprising an alloy composed mainly of 10 to 40% by weight of Cr, 1 to 10% by weight of Al, and a balance of iron, subjecting the cold-rolled sheet to intermediate annealing, cold-rolling the annealed sheet, subjecting the cold-rolled sheet to final annealing, cold rolling the annealed sheet with a total reduction ratio from the first pass to the final pass of 75% or more and heat-treating the cold-rolled sheet at a temperature in the range of from 80° to 500° C.

13. The process according to claim 12, wherein said thin sheet is a hot-rolled material.

14. The process according to claim 12, wherein said thin sheet is a continuously cast strip.

* * * * *